US008490291B2

(12) United States Patent
Churchill et al.

(10) Patent No.: US 8,490,291 B2
(45) Date of Patent: Jul. 23, 2013

(54) DRYER

(75) Inventors: John Churchill, Wiltshire (GB); James Dyson, Wiltshire (GB); Peter David Gammack, Wiltshire (GB)

(73) Assignee: Dyson Technology Limited, Malmesbury (GB)

( * ) Notice: Subject to any disclaimer, the term of this patent is extended or adjusted under 35 U.S.C. 154(b) by 751 days.

(21) Appl. No.: 11/997,303

(22) PCT Filed: Jun. 13, 2006

(86) PCT No.: PCT/GB2006/002139

§ 371 (c)(1),
(2), (4) Date: Jan. 29, 2008

(87) PCT Pub. No.: WO2007/015043

PCT Pub. Date: Feb. 8, 2007

(65) Prior Publication Data

US 2008/0222910 A1 Sep. 18, 2008

(30) Foreign Application Priority Data

Jul. 30, 2005 (GB) ..... 0515752.4

(51) Int. Cl.
*F26B 21/06* (2006.01)

(52) U.S. Cl.
USPC ..... 34/90; 34/104; 222/1; 4/263; 73/53.01; 392/384

(58) Field of Classification Search
USPC ..... 34/77, 78, 82, 86, 90, 104, 105, 565, 34/202; 222/1, 52; 4/263; 73/23.2, 53.01; 392/380, 381, 384
See application file for complete search history.

(56) References Cited

U.S. PATENT DOCUMENTS

| | | | |
|---|---|---|---|
| 16,110 | A | 11/1856 | Baldwin |
| 1,258,633 | A | 3/1918 | Heath |

(Continued)

FOREIGN PATENT DOCUMENTS

| | | |
|---|---|---|
| AU | 2005-203363 | 2/2006 |
| CA | 1124057 | 5/1982 |

(Continued)

OTHER PUBLICATIONS

GB Search Report dated Oct. 27, 2005, directed to counterpart GB application No. GB0515752.4.

(Continued)

*Primary Examiner* — Steve M Gravini
(74) *Attorney, Agent, or Firm* — Morrison & Foerster LLP

(57) ABSTRACT

A hand drying apparatus has a casing, a cavity formed in the casing for receiving a user's hands, a fan located in the casing and creating an airflow, and a plurality of openings communication with the fan and arranged to direct an airflow transversely across the cavity. The cavity has an entrance delimited by a front edge and a rear edge in which the openings are located. The shape of the front and rear edges is such that, when in use the user's hands are introduced to the cavity, the distance between the user's hands and the nearest opening is substantially uniform. Alternatively, one of the edges is substantially straight and the other of the said edges is curved so that the distance between the edges varies along the length of the cavity entrance. These arrangements enhance the drying efficiency of the dryer.

11 Claims, 5 Drawing Sheets

U.S. PATENT DOCUMENTS

| | | | | | |
|---|---|---|---|---|---|
| 1,500,094 | A | | 7/1924 | Kee | |
| 1,598,660 | A | | 9/1926 | Sieben | |
| 1,658,489 | A | | 2/1928 | Lindstrom | |
| 1,688,793 | A | | 10/1928 | Schrenkeisen | |
| 1,693,308 | A | | 11/1928 | Merkowitz | |
| 1,704,136 | A | | 3/1929 | Lemp | |
| 1,830,323 | A | | 11/1931 | Judelson et al. | |
| 1,961,179 | A | | 6/1934 | Tinkham | |
| 2,013,572 | A | | 9/1935 | McCord | |
| 2,104,135 | A | | 1/1938 | Morrill | |
| 2,109,028 | A | | 2/1938 | Miller | |
| 2,109,704 | A | | 3/1938 | Morrill | |
| 2,111,148 | A | | 3/1938 | Judelson | |
| 2,134,493 | A | | 10/1938 | Uroukoff | |
| 2,188,506 | A | | 1/1940 | Hall | |
| 2,260,558 | A | | 10/1941 | Caughey et al. | |
| 2,267,158 | A | | 12/1941 | Locke | |
| 2,278,574 | A | | 4/1942 | Spohr et al. | |
| 2,287,795 | A | | 6/1942 | Hall | |
| 2,385,962 | A | | 10/1945 | Barnett | |
| 2,438,762 | A | | 3/1948 | McLeckie | |
| 2,452,858 | A | | 11/1948 | Miller | |
| 2,479,387 | A | | 8/1949 | Matthews et al. | |
| 2,504,740 | A | | 4/1950 | Siegel | |
| 2,550,118 | A | | 4/1951 | Kauffman, II | |
| 2,645,032 | A | | 7/1953 | Hammell | |
| 2,761,222 | A | | 9/1956 | Bennett | |
| 2,859,535 | A | | 11/1958 | Carlson | |
| 2,911,732 | A | | 11/1959 | Webb | |
| 3,009,188 | A | | 11/1961 | Martin | |
| 3,071,801 | A | | 1/1963 | Scheiding | |
| 3,091,955 | A | | 6/1963 | Taylor et al. | |
| 3,096,702 | A | | 7/1963 | Malone, Sr. et al. | |
| 3,180,239 | A | | 4/1965 | Shearer et al. | |
| 3,233,339 | A | | 2/1966 | Long et al. | |
| 3,258,853 | A | | 7/1966 | Bradbury | |
| 3,305,938 | A | | 2/1967 | Arthur | |
| 3,312,160 | A | | 4/1967 | Rackley | |
| 3,321,844 | A | | 5/1967 | Seedorf | |
| 3,375,593 | A | | 4/1968 | Fleisher et al. | |
| 3,383,700 | A | | 5/1968 | Taylor | |
| 3,409,995 | A | | 11/1968 | Greenwood et al. | |
| 3,437,030 | A | | 4/1969 | Mastrosimone et al. | |
| 3,448,497 | A | | 6/1969 | Arnold et al. | |
| 3,464,388 | A | | 9/1969 | Stout | |
| 3,526,946 | A | | 9/1970 | Palmer | |
| 3,587,177 | A | | 6/1971 | Overly et al. | |
| 3,603,002 | A | | 9/1971 | Spierer | |
| 3,610,881 | A | | 10/1971 | Stewart | |
| 3,612,824 | A | | 10/1971 | Berryman | |
| 3,643,346 | A | | 2/1972 | Lester | |
| 3,667,134 | A | | 6/1972 | Rockson | |
| 3,670,718 | A | | 6/1972 | Brendgord | |
| 3,721,026 | A | | 3/1973 | McCallum | |
| 3,744,149 | A | * | 7/1973 | Helbling | 34/202 |
| 3,748,746 | A | | 7/1973 | Robandt | |
| 3,752,059 | A | | 8/1973 | Boyer | |
| 3,758,799 | A | | 9/1973 | Dochterman et al. | |
| 3,766,397 | A | * | 10/1973 | Rockson | 250/432 R |
| 3,785,523 | A | | 1/1974 | Goldstein | |
| 3,797,752 | A | | 3/1974 | Cercone | |
| 3,814,898 | A | | 6/1974 | Levine | |
| 3,826,607 | A | | 7/1974 | Kuhn | |
| 3,854,219 | A | | 12/1974 | Staats | |
| 3,874,073 | A | | 4/1975 | Dochterman et al. | |
| 3,952,867 | A | | 4/1976 | McCord | |
| 4,015,366 | A | | 4/1977 | Hall, III | |
| 4,039,774 | A | | 8/1977 | Kata et al. | |
| 4,047,692 | A | | 9/1977 | Swin, Sr. | |
| 4,085,522 | A | | 4/1978 | Stroszynski | |
| 4,087,925 | A | | 5/1978 | Bienek | |
| 4,091,762 | A | | 5/1978 | Ruehl | |
| 4,107,257 | A | | 8/1978 | Swin, Sr. | |
| 4,144,596 | A | | 3/1979 | MacFarlane et al. | |
| 4,145,769 | A | | 3/1979 | MacFarlane et al. | |
| 4,188,732 | A | | 2/1980 | Quayle | |
| 4,195,419 | A | | 4/1980 | Quayle | |
| 4,205,460 | A | | 6/1980 | Taylor | |
| 4,220,846 | A | | 9/1980 | Rice et al. | |
| 4,250,631 | A | | 2/1981 | Moses | |
| 4,267,643 | A | | 5/1981 | Haried | |
| 4,278,223 | A | * | 7/1981 | Fauteux | 248/125.8 |
| 4,295,233 | A | | 10/1981 | Hinkel et al. | |
| 4,310,747 | A | | 1/1982 | Rice et al. | |
| 4,312,139 | A | | 1/1982 | Preisler et al. | |
| 4,313,787 | A | | 2/1982 | Ciboit et al. | |
| 4,334,350 | A | | 6/1982 | Rice et al. | |
| RE31,023 | E | | 9/1982 | Hall, III | |
| 4,383,377 | A | | 5/1983 | Crafton | |
| 4,389,562 | A | | 6/1983 | Chaudoir | |
| 4,398,310 | A | | 8/1983 | Lienhard | |
| 4,489,507 | A | | 12/1984 | Kawai | |
| 4,495,086 | A | | 1/1985 | Hiroshima et al. | |
| 4,497,999 | A | | 2/1985 | Postbeschild | |
| 4,564,956 | A | | 1/1986 | DiBuono | |
| 4,600,128 | A | * | 7/1986 | Rohrer | 222/108 |
| 4,625,432 | A | | 12/1986 | Baltes | |
| 4,629,864 | A | | 12/1986 | Wilson | |
| 4,665,630 | A | | 5/1987 | Postbeschild | |
| 4,677,764 | A | | 7/1987 | Cerny | |
| 4,704,806 | A | * | 11/1987 | Gresens | 34/570 |
| 4,734,017 | A | | 3/1988 | Levin | |
| 4,754,607 | A | | 7/1988 | Mackay | |
| 4,802,287 | A | | 2/1989 | Chen | |
| 4,809,444 | A | | 3/1989 | Henderson et al. | |
| 4,826,262 | A | | 5/1989 | Hartman et al. | |
| 4,843,653 | A | | 7/1989 | Coble | |
| 4,857,705 | A | * | 8/1989 | Blevins | 392/381 |
| 4,876,435 | A | | 10/1989 | Hawkins | |
| 4,908,959 | A | | 3/1990 | Kretchman et al. | |
| 4,914,833 | A | | 4/1990 | Pilolla et al. | |
| 4,928,402 | A | | 5/1990 | Allen | |
| 4,941,521 | A | | 7/1990 | Redekop et al. | |
| 4,952,432 | A | | 8/1990 | Ten Wolde | |
| 4,986,681 | A | | 1/1991 | Oliver | |
| 4,991,314 | A | | 2/1991 | Allen | |
| 4,993,172 | A | * | 2/1991 | Allen | 34/202 |
| 5,031,337 | A | | 7/1991 | Pilolla et al. | |
| 5,047,351 | A | * | 9/1991 | Makiuchi et al. | 436/169 |
| 5,064,154 | A | | 11/1991 | Payne | |
| 5,074,322 | A | | 12/1991 | Jaw | |
| 5,107,603 | A | | 4/1992 | Durazzani | |
| 5,111,594 | A | | 5/1992 | Allen | |
| 5,146,695 | A | * | 9/1992 | Yang | 34/90 |
| 5,152,852 | A | * | 10/1992 | Hisamichi et al. | 152/209.8 |
| 5,168,621 | A | | 12/1992 | Kruck et al. | |
| 5,186,360 | A | | 2/1993 | Mease et al. | |
| 5,216,251 | A | * | 6/1993 | Matschke | 250/455.11 |
| 5,249,370 | A | | 10/1993 | Stanger et al. | |
| 5,253,373 | A | | 10/1993 | Tsipov | |
| 5,280,679 | A | | 1/1994 | Edelman | |
| 5,318,754 | A | | 6/1994 | Collins et al. | |
| 5,320,627 | A | | 6/1994 | Sorensen et al. | |
| 5,374,118 | A | | 12/1994 | Kruck et al. | |
| 5,377,427 | A | | 1/1995 | Mashata | |
| 5,379,483 | A | | 1/1995 | Pino | |
| 5,379,525 | A | | 1/1995 | Raynor | |
| 5,397,028 | A | | 3/1995 | Jesadanont | |
| 5,406,718 | A | | 4/1995 | Stein | |
| 5,407,354 | A | | 4/1995 | Fife | |
| 5,407,723 | A | | 4/1995 | Curtin | |
| 5,423,249 | A | | 6/1995 | Meyer | |
| 5,436,092 | A | * | 7/1995 | Ohtsuka et al. | 429/218.1 |
| 5,459,944 | A | * | 10/1995 | Tatsutani et al. | 34/202 |
| 5,522,411 | A | | 6/1996 | Johnson | |
| 5,545,451 | A | | 8/1996 | Haung et al. | |
| 5,546,678 | A | | 8/1996 | Dhaemers | |
| 5,555,640 | A | | 9/1996 | Ou | |
| 5,601,870 | A | | 2/1997 | Haung et al. | |
| 5,612,083 | A | | 3/1997 | Haung et al. | |
| 5,620,249 | A | | 4/1997 | Musil | |
| 5,636,815 | A | | 6/1997 | Wilson | |
| 5,755,040 | A | | 5/1998 | Ou | |
| 5,870,836 | A | | 2/1999 | Grimes | |
| 5,873,178 | A | * | 2/1999 | Johnson | 34/90 |
| 5,875,562 | A | | 3/1999 | Fogarty | |
| 5,882,743 | A | | 3/1999 | McConnell | |

5,901,462 A 5/1999 Rudd
5,924,148 A 7/1999 Flowers, Sr.
5,945,068 A 8/1999 Ferone
5,972,474 A * 10/1999 Tsuzuki et al. ..... 428/141
5,974,685 A 11/1999 Hironaka
5,987,773 A 11/1999 Lipscy
6,005,227 A 12/1999 Pappas
6,018,885 A 2/2000 Hill
6,038,786 A * 3/2000 Aisenberg et al. ..... 34/267
6,047,485 A 4/2000 Madyun
6,050,000 A 4/2000 Curzon
6,050,275 A 4/2000 Kamikawa et al.
6,085,442 A 7/2000 Erickson
6,104,302 A 8/2000 Vuong
6,119,361 A 9/2000 Baker
6,119,437 A 9/2000 Baker
6,131,588 A 10/2000 Kamikawa et al.
6,137,067 A 10/2000 Helms et al.
6,158,673 A 12/2000 Toetschinger et al.
6,185,838 B1 * 2/2001 Moore ..... 34/202
6,189,230 B1 2/2001 Huen
6,199,515 B1 3/2001 Clarke
6,206,980 B1 3/2001 Robinson
6,256,903 B1 7/2001 Rudd
6,263,591 B1 7/2001 La Porte
6,279,836 B1 8/2001 Toetschinger et al.
6,280,092 B1 8/2001 Backus et al.
6,282,812 B1 9/2001 Wee et al.
6,295,410 B1 9/2001 Helms et al.
6,298,777 B1 10/2001 Dubois et al.
6,342,104 B1 1/2002 Kamikawa et al.
6,431,189 B1 8/2002 Deibert
6,431,217 B2 8/2002 Robinson
6,606,801 B2 8/2003 Strang et al.
6,620,504 B2 9/2003 Mizumura et al.
6,624,606 B2 9/2003 Kushida et al.
6,651,357 B2 11/2003 Bria et al.
6,681,497 B2 1/2004 Bria et al.
6,684,648 B2 2/2004 Faqih
6,705,107 B2 3/2004 Schlosser et al.
6,732,858 B1 5/2004 Chang Ou
6,746,543 B2 6/2004 Kamikawa et al.
6,749,148 B2 6/2004 Helfer-Grand
6,766,589 B1 7/2004 Bory et al.
6,769,197 B1 8/2004 Tai
6,793,851 B1 9/2004 Bompay et al.
6,845,569 B1 1/2005 Kim
6,860,032 B2 3/2005 Meyer
6,892,475 B2 5/2005 Wakamatsu et al.
6,914,341 B1 7/2005 McIntyre
6,956,498 B1 10/2005 Gauthier et al.
6,962,235 B2 * 11/2005 Leon ..... 182/73
6,973,740 B2 12/2005 Meyer
7,036,242 B2 * 5/2006 Komulainen et al. ..... 34/117
7,036,575 B1 5/2006 Rodney et al.
7,039,301 B1 * 5/2006 Aisenberg et al. ..... 392/380
7,040,021 B2 5/2006 Talavera
7,042,714 B2 5/2006 Hillman et al.
7,055,262 B2 6/2006 Goldberg et al.
7,087,117 B2 8/2006 Katsuoka et al.
7,150,890 B2 12/2006 Rosales et al.
7,182,820 B2 2/2007 Campbell et al.
7,284,391 B2 10/2007 Miller et al.
7,309,376 B2 12/2007 Barre et al.
7,316,080 B1 1/2008 Woolsey
7,380,348 B2 6/2008 Seebach
7,437,833 B2 * 10/2008 Sato et al. ..... 34/90
7,442,257 B2 10/2008 Katsuoka et al.
7,506,458 B2 3/2009 Lee et al.
7,509,998 B1 3/2009 Rodney
7,526,833 B2 5/2009 Cochran et al.
7,555,209 B2 6/2009 Pradas Diez et al.
7,562,543 B2 7/2009 Kendall et al.
7,575,636 B2 8/2009 Katsuoka et al.
7,587,917 B2 9/2009 Gilboe et al.
7,596,883 B2 10/2009 Kameishi
7,597,122 B1 10/2009 Smith
7,614,160 B2 11/2009 Kameishi et al.
7,617,702 B2 11/2009 Sunshine et al.
7,624,600 B2 12/2009 Sunshine et al.
7,628,043 B2 12/2009 Sunshine et al.
7,640,678 B2 1/2010 Lee et al.
7,653,963 B2 2/2010 Cochran et al.
7,665,225 B2 2/2010 Goldberg et al.
7,802,340 B2 9/2010 Knopow et al.
7,832,697 B2 11/2010 West et al.
7,856,736 B2 12/2010 Churchill et al.
7,946,055 B2 5/2011 Churchill et al.
2001/0000576 A1 5/2001 Robinson
2001/0027795 A1 10/2001 Cain-Kozma et al.
2002/0004994 A1 1/2002 Rudd
2002/0046569 A1 4/2002 Faqih
2002/0078705 A1 6/2002 Schlosser et al.
2002/0092198 A1 7/2002 Bria et al.
2002/0132214 A1 9/2002 Mattson et al.
2002/0185987 A1 12/2002 Kushida et al.
2002/0198662 A1 12/2002 Chen
2003/0000036 A1 1/2003 Fan
2003/0001468 A1 1/2003 Hase et al.
2003/0066281 A1 4/2003 Mizumura et al.
2003/0071075 A1 4/2003 Frankenbach et al.
2003/0074718 A1 4/2003 English
2003/0159718 A1 8/2003 Kamikawa et al.
2003/0172547 A1 9/2003 Shephard, II
2003/0188448 A1 10/2003 Reed
2004/0031119 A1 2/2004 McKay
2004/0045168 A1 3/2004 Talavera
2004/0049940 A1 * 3/2004 Komulainen et al. ..... 34/114
2004/0088817 A1 5/2004 Cochran et al.
2004/0090040 A1 5/2004 Pearson
2004/0108281 A1 6/2004 Gerteis et al.
2004/0111817 A1 6/2004 Chen et al.
2004/0168342 A1 9/2004 Wakamatsu et al.
2004/0226312 A1 11/2004 Miller et al.
2004/0244090 A1 12/2004 Langer
2004/0255484 A1 12/2004 Storrer et al.
2005/0036283 A1 2/2005 Hillman et al.
2005/0066538 A1 3/2005 Goldberg et al.
2005/0072358 A1 4/2005 Katsuoka et al.
2005/0076529 A1 4/2005 Holmes
2005/0076662 A1 4/2005 Roche et al.
2005/0100436 A1 5/2005 Egusquiza
2005/0120508 A1 6/2005 Morgan et al.
2005/0153002 A1 7/2005 Socla Rosales et al.
2005/0211357 A1 9/2005 Ren
2005/0258114 A1 11/2005 Davis
2005/0262720 A1 12/2005 Rane et al.
2005/0273969 A1 12/2005 Watson et al.
2006/0000110 A1 * 1/2006 Aisenberg et al. ..... 34/443
2006/0036198 A1 2/2006 Cafaro et al.
2006/0060082 A1 3/2006 Barre et al.
2006/0096118 A1 5/2006 Ward, III et al.
2006/0171660 A1 8/2006 Hsu
2006/0179676 A1 8/2006 Goldberg et al.
2006/0180596 A1 8/2006 Young et al.
2006/0191901 A1 8/2006 Taylor et al.
2006/0201015 A1 9/2006 Russell
2006/0201018 A1 9/2006 McKay et al.
2006/0206233 A1 9/2006 Carpenter et al.
2006/0230630 A1 10/2006 Lee et al.
2006/0236929 A1 10/2006 Katsuoka et al.
2006/0243204 A1 11/2006 Katsuoka et al.
2006/0243205 A1 11/2006 Katsuoka et al.
2006/0272120 A1 12/2006 Barrick et al.
2006/0272170 A1 12/2006 Holmes
2006/0288508 A1 12/2006 Knopow et al.
2007/0033937 A1 2/2007 Baur et al.
2007/0079524 A1 4/2007 Sato et al.
2007/0094884 A1 * 5/2007 Micheludis ..... 34/107
2007/0113369 A1 5/2007 Cochran et al.
2007/0144034 A1 * 6/2007 Kameishi ..... 34/523
2007/0160515 A1 7/2007 Mohrman
2007/0163141 A1 7/2007 Hsu
2007/0263994 A1 11/2007 Diez et al.
2007/0274822 A1 11/2007 Liu et al.
2007/0290110 A1 12/2007 West et al.
2008/0004963 A1 1/2008 Montalbano et al.
2008/0022551 A1 1/2008 Banta et al.

| | | | | |
|---|---|---|---|---|
| 2008/0032066 | A1 | 2/2008 | Stiblert et al. | |
| 2008/0052952 | A1 | 3/2008 | Nelson | |
| 2008/0127830 | A1 | 6/2008 | Le et al. | |
| 2008/0209760 | A1* | 9/2008 | French et al. | 34/585 |
| 2008/0216342 | A1* | 9/2008 | Kameishi et al. | 34/202 |
| 2008/0216343 | A1* | 9/2008 | Churchill et al. | 34/202 |
| 2008/0216344 | A1* | 9/2008 | Churchill et al. | 34/202 |
| 2008/0222910 | A1* | 9/2008 | Churchill et al. | 34/202 |
| 2008/0253754 | A1 | 10/2008 | Rubin | |
| 2008/0256825 | A1 | 10/2008 | Hsu | |
| 2008/0259566 | A1 | 10/2008 | Fried | |
| 2008/0263889 | A1 | 10/2008 | Fukaya et al. | |
| 2008/0272734 | A1 | 11/2008 | Ren | |
| 2008/0301970 | A1* | 12/2008 | Hackwell et al. | 34/202 |
| 2008/0313918 | A1* | 12/2008 | Dyson et al. | 34/202 |
| 2008/0313919 | A1* | 12/2008 | Churchill et al. | 34/202 |
| 2008/0317448 | A1* | 12/2008 | Brown et al. | 392/380 |
| 2009/0000142 | A1* | 1/2009 | Churchill et al. | 34/95 |
| 2009/0004962 | A1 | 1/2009 | Collins | |
| 2009/0034946 | A1* | 2/2009 | Caine et al. | 392/380 |
| 2009/0044420 | A1 | 2/2009 | Hsu | |
| 2009/0071030 | A1 | 3/2009 | Myung et al. | |
| 2009/0077736 | A1 | 3/2009 | Loberger et al. | |
| 2009/0113746 | A1* | 5/2009 | Churchill et al. | 34/202 |
| 2009/0113748 | A1* | 5/2009 | Dyson et al. | 34/232 |
| 2009/0119942 | A1* | 5/2009 | Aisenberg et al. | 34/418 |
| 2009/0130745 | A1 | 5/2009 | Williams et al. | |
| 2009/0195877 | A1* | 8/2009 | Nakai | 359/500 |
| 2009/0221059 | A1 | 9/2009 | Williams et al. | |
| 2009/0236629 | A1* | 9/2009 | Nishikawa et al. | 257/103 |
| 2009/0255142 | A1 | 10/2009 | Brown | |
| 2009/0293304 | A1 | 12/2009 | Yang | |
| 2009/0320316 | A1 | 12/2009 | Zakai | |
| 2010/0005614 | A1 | 1/2010 | Cochran et al. | |
| 2010/0024244 | A1 | 2/2010 | Potter | |
| 2010/0052408 | A1 | 3/2010 | Ren | |
| 2010/0119755 | A1* | 5/2010 | Chung et al. | 428/36.91 |
| 2010/0130686 | A1* | 5/2010 | Oshima | 525/102 |
| 2010/0154239 | A1 | 6/2010 | Hutchinson | |
| 2010/0154863 | A1 | 6/2010 | Bennett et al. | |
| 2010/0192399 | A1 | 8/2010 | Sawabe et al. | |
| 2010/0209080 | A1 | 8/2010 | Rubin et al. | |
| 2010/0210745 | A1 | 8/2010 | McDaniel et al. | |
| 2010/0212177 | A1 | 8/2010 | Chen | |
| 2010/0227963 | A1 | 9/2010 | Hironaka et al. | |
| 2011/0082021 | A1 | 4/2011 | Burns | |
| 2011/0099834 | A1 | 5/2011 | Brown | |
| 2011/0131829 | A1 | 6/2011 | Zagar et al. | |

FOREIGN PATENT DOCUMENTS

| | | | |
|---|---|---|---|
| CH | 645277 | | 9/1984 |
| CH | 658372 | | 11/1986 |
| CH | 669116 | | 2/1989 |
| CN | 2684294 | | 3/2005 |
| CZ | 15 805 | | 11/2005 |
| DE | 548 998 | | 4/1932 |
| DE | 26 57 164 | | 6/1978 |
| DE | 3116285 | | 2/1983 |
| DE | 3204258 | | 8/1983 |
| DE | 3218578 | | 11/1983 |
| DE | 3440412 | | 3/1986 |
| DE | 3530888 | | 3/1986 |
| DE | 3443438 | | 5/1986 |
| DE | 3443439 | | 5/1986 |
| DE | 3508316 | | 9/1986 |
| DE | 3513159 | | 10/1986 |
| DE | 3527835 | | 2/1987 |
| DE | 3529410 | | 2/1987 |
| DE | 3735197 | | 5/1989 |
| DE | 3814489 | | 11/1989 |
| DE | 4022003 | | 1/1992 |
| DE | 4107439 | | 9/1992 |
| DE | 4107489 | | 9/1992 |
| DE | 4218658 | | 12/1992 |
| DE | 4208680 | | 9/1993 |
| DE | 4428978 | | 3/1995 |
| DE | 196 12 923 | | 10/1997 |
| DE | 19654756 | | 7/1998 |
| DE | 10109237 | | 9/2002 |
| DE | 101 14 473 | | 10/2002 |
| DE | 10147778 | | 4/2003 |
| DE | 10157975 | | 6/2003 |
| EP | 0 059 888 | | 9/1982 |
| EP | 0 068 491 | | 1/1983 |
| EP | 0 211 418 | | 2/1987 |
| EP | 251898 | | 1/1988 |
| EP | 329171 | | 8/1989 |
| EP | 357305 | A1 * | 3/1990 |
| EP | 382521 | | 8/1990 |
| EP | 393254 | | 10/1990 |
| EP | 0 438 208 | | 7/1991 |
| EP | 0567678 | | 11/1993 |
| EP | 0574160 | | 12/1993 |
| EP | 0 589 568 | | 3/1994 |
| EP | 0644334 | | 3/1995 |
| EP | 0679358 | | 11/1995 |
| EP | 832697 | | 4/1998 |
| EP | 855736 | | 7/1998 |
| EP | 976356 | | 2/2000 |
| EP | 1166704 | | 1/2002 |
| EP | 1250878 | | 10/2002 |
| EP | 1250879 | | 10/2002 |
| FR | 2 537 425 | | 6/1984 |
| FR | 2543592 | | 10/1984 |
| FR | 2569029 | | 2/1986 |
| FR | 2577109 | | 8/1986 |
| FR | 2582196 | | 11/1986 |
| FR | 2588741 | | 4/1987 |
| FR | 2595455 | | 9/1987 |
| FR | 2 597 717 | | 10/1987 |
| FR | 2790979 | | 9/2000 |
| GB | 493258 | | 10/1938 |
| GB | 680148 | | 10/1952 |
| GB | 1024671 | | 3/1966 |
| GB | 2 012 362 | | 7/1979 |
| GB | 2050609 | | 1/1981 |
| GB | 2054151 | | 2/1981 |
| GB | 2057528 | | 4/1981 |
| GB | 2085725 | | 5/1982 |
| GB | 2112639 | | 7/1983 |
| GB | 2116034 | | 9/1983 |
| GB | 2 136 291 | | 9/1984 |
| GB | 2137878 | | 10/1984 |
| GB | 2142128 | | 1/1985 |
| GB | 2144325 | | 3/1985 |
| GB | 2147804 | | 5/1985 |
| GB | 2 179 856 | | 3/1987 |
| GB | 2 189 382 | | 10/1987 |
| GB | 2196843 | | 5/1988 |
| GB | 2198229 | | 6/1988 |
| GB | 2236248 | | 4/1991 |
| GB | 2 249 026 | | 4/1992 |
| GB | 2 253 035 | | 8/1992 |
| GB | 2 405 583 | | 3/2005 |
| GB | 2434094 | A * | 7/2007 |
| JP | 59-200143 | | 11/1984 |
| JP | 61-21393 | | 2/1986 |
| JP | 63-154138 | | 6/1988 |
| JP | 63-163693 | | 10/1988 |
| JP | 63-279033 | | 11/1988 |
| JP | 2-52973 | | 2/1990 |
| JP | 03-082419 | | 4/1991 |
| JP | 03-082420 | | 4/1991 |
| JP | 04-073026 | | 3/1992 |
| JP | 5-49553 | | 3/1993 |
| JP | 6-062979 | | 3/1994 |
| JP | 6-63909 | | 3/1994 |
| JP | 6-209879 | | 8/1994 |
| JP | 07-079880 | | 3/1995 |
| JP | 07-116076 | | 5/1995 |
| JP | 7-280419 | | 10/1995 |
| JP | 7-308266 | | 11/1995 |
| JP | 8-140891 | | 6/1996 |
| JP | 08187209 | A * | 7/1996 |
| JP | 8-196470 | | 8/1996 |
| JP | 8-196798 | | 8/1996 |
| JP | 8-291703 | | 11/1996 |
| JP | 8-318176 | | 12/1996 |

| | | | |
|---|---|---|---|
| JP | 9-66003 | | 3/1997 |
| JP | 9-135789 | | 5/1997 |
| JP | 10-113304 | | 5/1998 |
| JP | 10248748 | A * | 9/1998 |
| JP | 10-281627 | | 10/1998 |
| JP | 11-283 | | 1/1999 |
| JP | 11-18999 | | 1/1999 |
| JP | 11-56673 | | 3/1999 |
| JP | 11-70058 | | 3/1999 |
| JP | 11-178742 | | 7/1999 |
| JP | 11-178744 | | 7/1999 |
| JP | 11-244191 | | 9/1999 |
| JP | 11-287544 | | 10/1999 |
| JP | 2000-178 | | 1/2000 |
| JP | 2000-107073 | | 4/2000 |
| JP | 2000-157447 | | 6/2000 |
| JP | 2000-157448 | | 6/2000 |
| JP | 2000-245653 | | 9/2000 |
| JP | 2000-300465 | | 10/2000 |
| JP | 2000-308598 | | 11/2000 |
| JP | 2000-316747 | | 11/2000 |
| JP | 2001-37675 | | 2/2001 |
| JP | 2001-87163 | | 4/2001 |
| JP | 2001-149262 | | 6/2001 |
| JP | 2001-157647 | | 6/2001 |
| JP | 2001-275898 | | 10/2001 |
| JP | 2001-346715 | | 12/2001 |
| JP | 2002-034835 | | 2/2002 |
| JP | 2002-34841 | | 2/2002 |
| JP | 2002-34843 | | 2/2002 |
| JP | 2002-34844 | | 2/2002 |
| JP | 2002-034845 | | 2/2002 |
| JP | 2002034852 | A * | 2/2002 |
| JP | 2002-136448 | | 5/2002 |
| JP | 2002-306370 | | 10/2002 |
| JP | 2002-345681 | | 12/2002 |
| JP | 2003-153823 | | 5/2003 |
| JP | 2003-180554 | | 7/2003 |
| JP | 2003-180555 | | 7/2003 |
| JP | 2003-235757 | | 8/2003 |
| JP | 2003-275129 | | 9/2003 |
| JP | 2004-97840 | | 4/2004 |
| JP | 2004-105511 | | 4/2004 |
| JP | 2004-113615 | | 4/2004 |
| JP | 2004-113712 | | 4/2004 |
| JP | 2004-215879 | | 8/2004 |
| JP | 2004-231935 | | 8/2004 |
| JP | 2004-261275 | | 9/2004 |
| JP | 2004-261510 | | 9/2004 |
| JP | 2004-305287 | | 11/2004 |
| JP | 2004-357820 | | 12/2004 |
| JP | 2005-27693 | | 2/2005 |
| JP | 2005-160872 | | 6/2005 |
| JP | 2005-160874 | | 6/2005 |
| JP | 2005-168799 | | 6/2005 |
| JP | 2005-177415 | | 7/2005 |
| JP | 2005-198933 | | 7/2005 |
| JP | 2005-291274 | | 10/2005 |
| JP | 2006187397 | A * | 7/2006 |
| JP | 2006-263152 | | 10/2006 |
| WO | WO-85/03462 | | 8/1985 |
| WO | WO-85/04184 | | 9/1985 |
| WO | WO-86/06693 | | 11/1986 |
| WO | WO-87/07040 | | 11/1987 |
| WO | WO 97/34708 | | 9/1997 |
| WO | WO-98/26703 | | 6/1998 |
| WO | WO-98/53752 | | 12/1998 |
| WO | WO-99/53250 | | 10/1999 |
| WO | WO-01/25705 | | 4/2001 |
| WO | WO-03/024291 | | 3/2003 |
| WO | WO-2004/100743 | | 11/2004 |
| WO | WO 2005/029687 | | 3/2005 |
| WO | WO-2005/074776 | | 8/2005 |
| WO | WO-2007/015039 | | 2/2007 |
| WO | WO-2007/015042 | | 2/2007 |
| WO | WO-2007/015044 | | 2/2007 |
| WO | WO 2007015040 | A1 * | 2/2007 |
| WO | WO 2007015045 | A1 * | 2/2007 |

OTHER PUBLICATIONS

GB Search Report dated Nov. 24, 2005, directed to counterpart GB application No. GB0515752.4.
International Search Report dated Jul. 17, 2006, directed to counterpart PCT application No. PCT/GB2006/002139.
GB Search Report dated Aug. 25, 2006, directed to Application No. GB0600881.7; 1 page.
GB Search Report dated Oct. 28, 2005, directed to Application No. GB0515744.1; 1 page.
International Search Report mailed Aug. 7, 2006, directed to Application No. PCT/GB2006/002138; 1 page.
GB Search Report dated Oct. 27, 2005, directed to GB application No. GB0515749.0; 1 page.
International Search Report dated Aug. 25, 2006, directed to PCT application No. PCT/GB2006/002199; 2 pages.
Churchill et al., U.S. Office Action mailed Apr. 1, 2010, directed to U.S. Appl. No. 11/997,301; 10 pages.
Churchill et al., U.S. Office Action mailed Aug. 12, 2011, directed to U.S. Appl. No. 11/997,311; 7 pages.
Hackwell et al., U.S. Office Action mailed Apr. 4, 2011, directed to U.S. Appl. No. 11/997,305; 7 pages.
Hackwell et al., U.S. Office Action mailed Oct. 17, 2011, directed to U.S. Appl. No. 11/997,305; 7 pages.
French et al., U.S. Office Action mailed Jan. 20, 2012, directed to U.S. Appl. No. 11/997,309; 7 pages.
Dyson et al., U.S. Office Action mailed Jan. 18, 2012, directed to U.S. Appl. No. 11/997,308; 7 pages.
Churchill et al., U.S. Office Action mailed Sep. 28, 2011, directed to U.S. Appl. No. 11/997,310; 7 pages.
French et al., U.S. Office Action mailed Aug. 11, 2011, directed to U.S. Appl. No. 11/997,309; 8 pages.
Dyson et al., U.S. Office Action mailed Jul. 22, 2011, directed to U.S. Appl. No. 11/997,302; 14 pages.
Dyson et al., U.S. Office Action mailed Aug. 8, 2011, directed to U.S. Appl. No. 11/997,308; 8 pages.
Caine et al., U.S. Office Action mailed Jul. 8, 2011, directed to U.S. Appl. No. 12/159,559; 6 pages.
Hutchinson, U.S. Office Action mailed Jun. 24, 2010, directed to U.S. Appl. No. 12/160,961; 8 pages.
Hutchinson, U.S. Office Action mailed Dec. 9, 2010, directed to U.S. Appl. No. 12/160,961; 10 pages.
Churchill et al., U.S. Office Action mailed Mar. 23, 2012, directed to U.S. Appl. No. 11/997,311; 7 pages.
Churchill et al., U.S. Office Action mailed Feb. 13, 2012, directed to U.S. Appl. No. 11/997,310; 5 pages.
Hutchinson, U.S. Office Action mailed Mar. 19, 2012, directed to U.S. Appl. No. 12/160,961; 8 pages.
GB Search Report mailed Mar. 27, 2006, directed at counterpart GB application No. 0600534.2; 1 page.
International Search Report mailed Mar. 16, 2007, directed at counterpart international application No. PCT/GB2007/000089; 4 pages.
International Search Report and Written Opinion of the International Searching Authority dated Aug. 25, 2006, directed to counterpart application No. PCT/GB2006/002084; 14 pages.
GB Search Report dated Nov. 18, 2005, directed to counterpart GB Application No. GB0515754.0; 1 page.
Churchill et al., U.S. Office Action mailed Oct. 22, 2010, directed to U.S. Appl. No. 11/997,301; 15 pages.
Hutchinson, U.S. Office Action mailed Sep. 14, 2012, directed to U.S. Appl. No. 12/160,961; 11 pages.

* cited by examiner

DRYER

REFERENCE TO RELATED APPLICATIONS

This application is a national stage application under 35 USC 371 of International Application No. PCT/GB2006/002139, filed Jun. 13, 2006, which claims the priority of United Kingdom Application No. 0515752.4, filed Jul. 30, 2005, the contents of which prior applications are incorporated herein by reference.

FIELD OF THE INVENTION

The invention relates to a dryer which makes use of narrow streams of high velocity, high pressure air to dry a user's hands.

BACKGROUND OF THE INVENTION

The use of air jets to dry hands is well known. Examples of hand dryers which emit at least one air jet for the purposes of drying hands are shown in GB 2249026A, JP 2002 034835A and JP 2002306370A. A further example of a known hand dryer is shown in JP 11244191. In this latter prior art document, the cavity into which the user is invited to place his or her hands is shaped by providing the cavity with curved walls. Nozzles are provided in the curved walls so that individual jets of air are blown onto the user's hands for the purpose of drying the user's hands. However, in the arrangement shown, the rate of drying will be different for different sides of the user's hands. This will result in the user needing to use the dryer to dry part of his or her hands after another part has already been dried. This will result in discomfort and is also inefficient.

SUMMARY OF THE INVENTION

It is an object of the invention to provide drying apparatus which, in use, dries the user's hands at an even rate as compared to the prior art. It is another object to provide an improved hand dryer in which the drying efficiency is improved in comparison to the prior art.

A first aspect of the invention provides hand drying apparatus having a casing, a cavity formed in the casing for receiving for receiving a user's hands, a fan located in the casing and capable of creating an airflow, and a plurality of openings communicating with the fan and arranged to direct an airflow transversely across the cavity, wherein the cavity has an entrance delimited by a front edge and a rear edge in which the openings are located, the shape of the front and rear edges being such that, when in use the user's hands are introduced to the cavity, the distance between the user's hands and the nearest opening is substantially uniform.

A second aspect of the invention also provides hand drying apparatus having a casing, a cavity formed in the casing for receiving for receiving a user's hands, a fan located in the casing and capable of creating an airflow, and a plurality of openings communicating with the fan and arranged to direct an airflow transversely across the cavity, wherein the cavity has an entrance delimited by a front edge and a rear edge in which the openings are located, one of the said edges being substantially straight and the other of the said edges being curved so that the distance between the said edges varies along the length of the cavity entrance.

Both aspects of the invention provide arrangements in which, in use, the distance between the openings through which drying air is emitted and the adjacent surfaces of the user's hands is kept substantially constant. This is particularly advantageous when the undersides (or palms) of the users hands are considered.

Preferably, the front edge of the cavity entrance is substantially straight and the rear edge is curved. More preferably, the rear edge comprises two curved portions which are arranged symmetrically about the centre of the cavity entrance, and the distance between the front and rear edges decreases towards the centre of the cavity entrance. These features result in a shape which corresponds closely to the shape of a user's hands when in a normal, relaxed state suitable for drying and so minimise the time required to dry the user's hands evenly and quickly.

In a preferred embodiment, the openings in the front and rear edges are formed by continuous slots. This minimises the risk of small areas of the user's hands not being dried by the drying apparatus.

BRIEF DESCRIPTION OF THE DRAWINGS

An embodiment of the invention will now be described with reference to the accompanying drawings, in which.

DETAILED DESCRIPTION OF THE INVENTION

Figure 2:
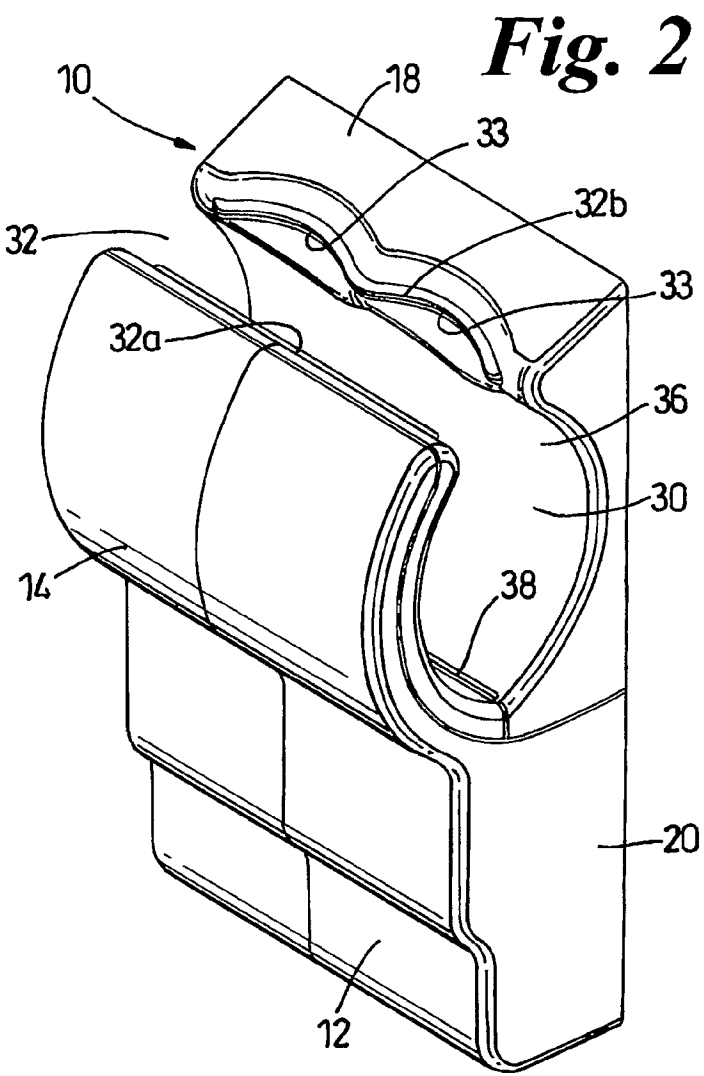
FIG. 2 is a perspective view of the hand dryer of FIG. 1.
Figure 1:
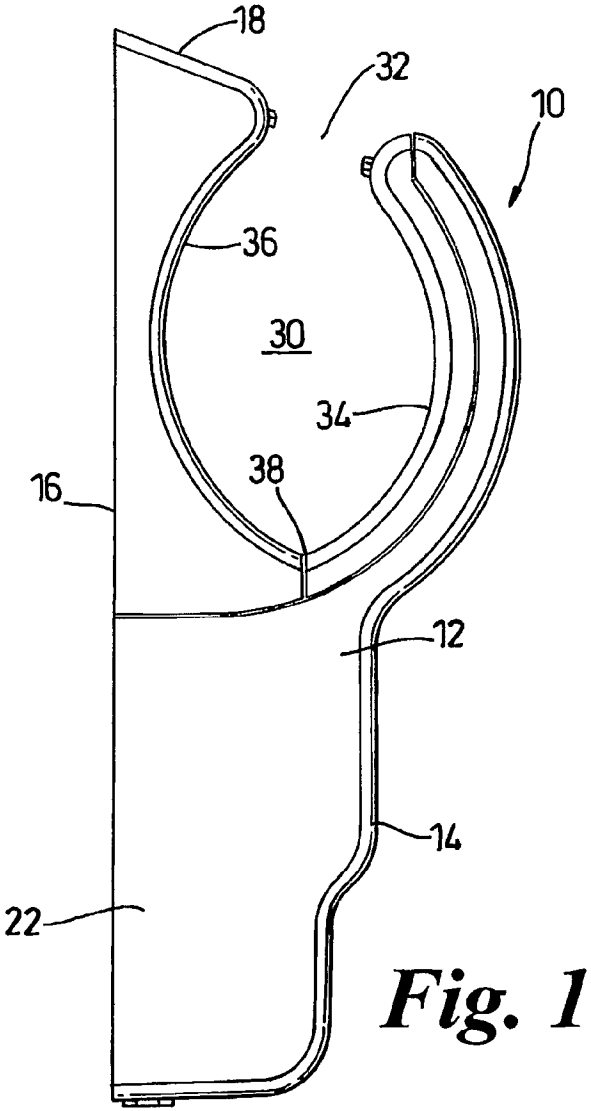
FIG. 1 is a side view of a hand dryer according to the invention.

Referring firstly to FIGS. 1 and 2, the hand dryer 10 shown in the drawings comprises an outer casing 12 having a front wall 14, a rear wall 16, an upper face 18 and side walls 20, 22. The rear wall 16 can incorporate fixing devices (not shown) for securing the hand dryer 10 to a wall or other structure prior to use. An electrical connection (not shown) is also provided on the rear wall or elsewhere on the casing 12. A cavity 30 is formed in the upper part of the casing 12 as can be seen from FIGS. 1 and 2. The cavity 30 is open at its upper end and delimited thereat by the top of the front wall 14 and the front of the upper face 18. The space between the top of the front wall 14 and the front of the upper face 18 forms a cavity entrance 32 which is sufficiently wide to allow a user's hands to be introduced to the cavity 30 through the cavity entrance 32. The cavity 30 is also open to the sides of the hand dryer 10 by appropriate shaping of the side walls 20, 22.

The cavity 30 has a front wall 34 and a rear wall 36 which delimit the cavity 30 to the front and rear respectively. Located in the lowermost end of the cavity 30 is a drain 38 which communicates with a reservoir (not shown) located in the lower part of the casing 12. The purpose of the drain and reservoir will be described below.

Figure 3:
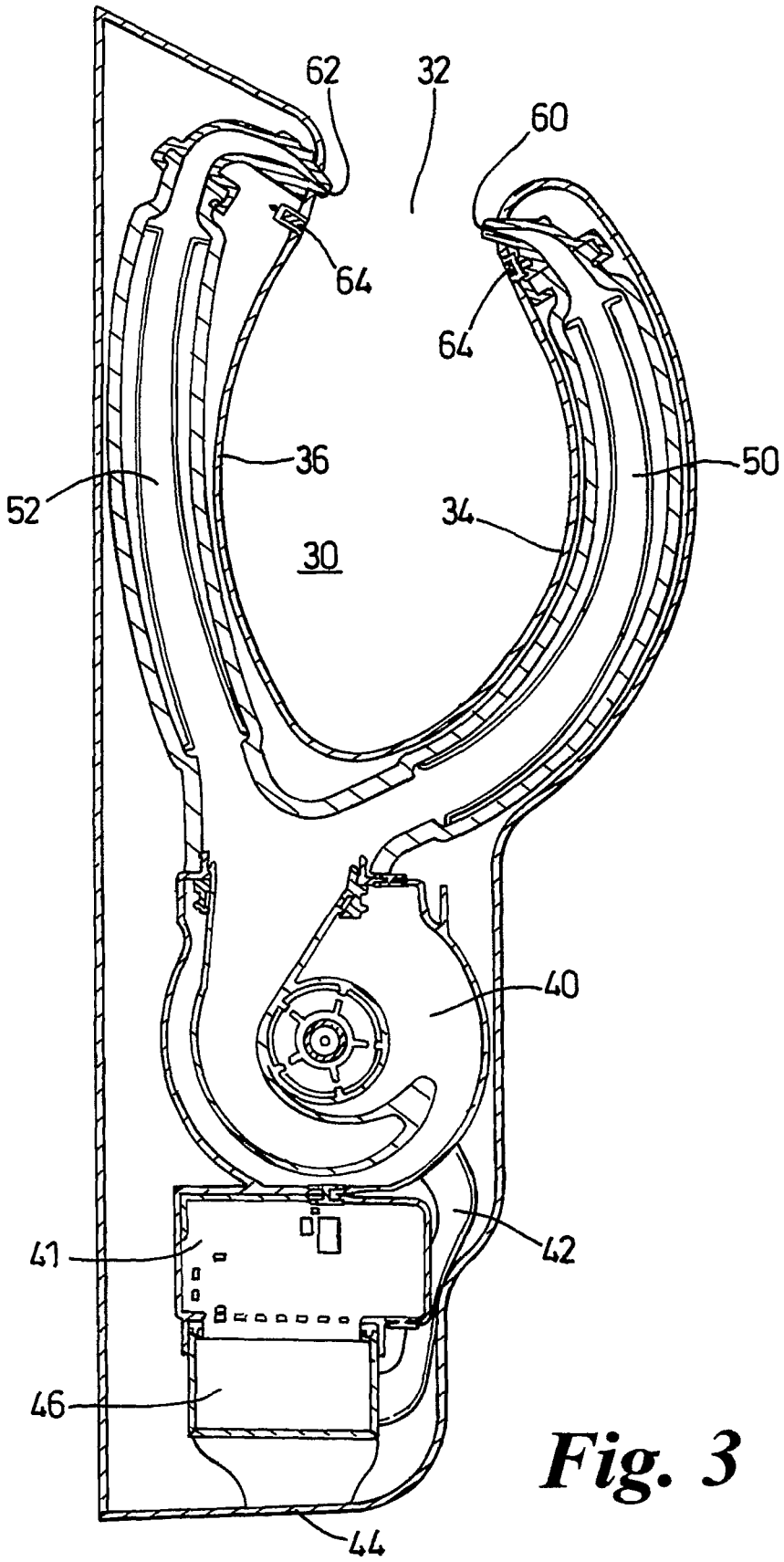
FIG. 3 is a side sectional view of the hand dryer of FIG. 1.

As shown in FIG. 3, a motor (not shown) is located inside the casing 12 and a fan 40, which is driven by the motor, is also located inside the casing 12. The motor is connected to the electrical connection and is controlled by a controller 41. The inlet 42 of the fan 40 communicates with an air inlet 44 formed in the casing 12. A filter 46 is located in the air passageway connecting the air inlet 44 to the fan inlet 42 so as to prevent the ingress of any debris which might cause damage to the motor or the fan 40. The outlet of the fan 40 communicates with a pair of air ducts 50, 52 which are located inside the casing 12. The front air duct 50 is located primarily between the front wall 14 of the casing 12 and the front wall 34 of the cavity 30, and the rear air duct 52 is located primarily between the rear wall 16 of the casing 12 and the rear wall 36 of the cavity 30.

The air ducts 50, 52 are arranged to conduct air from the fan 40 to a pair of opposed slot-like openings 60, 62 which are located in the front and rear walls 34, 36 respectively of the cavity 30. The slot-like openings 60, 62 are arranged at the upper end of the cavity 30 in the vicinity of the cavity entrance 32. The slot-like openings 60, 62 are each configured so as to direct an airflow generally across the cavity entrance 32 towards the opposite wall of the cavity 30. The slot-like openings 60, 62 are offset in the vertical direction and angled towards the base of the cavity 30.

Figure 4:
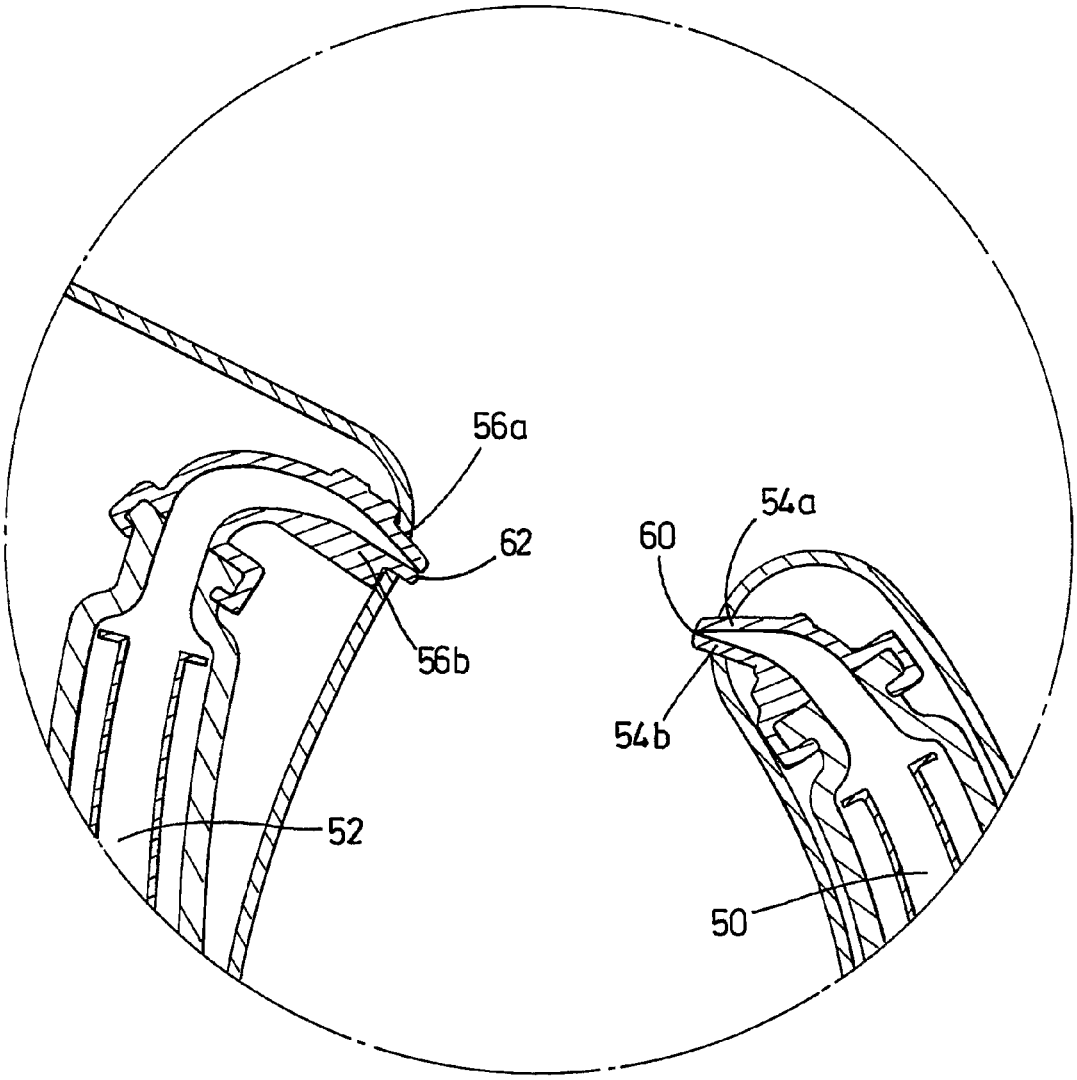
FIG. 4 is a side sectional view, shown on an enlarged scale, of the upper ends of the air ducts forming part of the hand dryer of FIG. 1.
Figure 5:
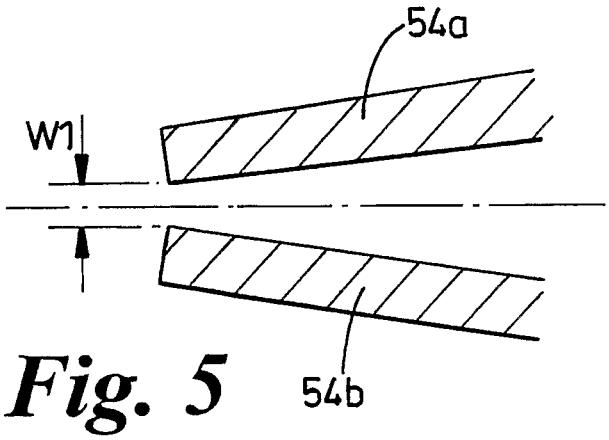
FIG. 5 is a schematic sectional side view, shown on a further enlarged scale, of the slot-like opening located in the front wall of the cavity of the hand dryer of FIG. 1.
Figure 6:
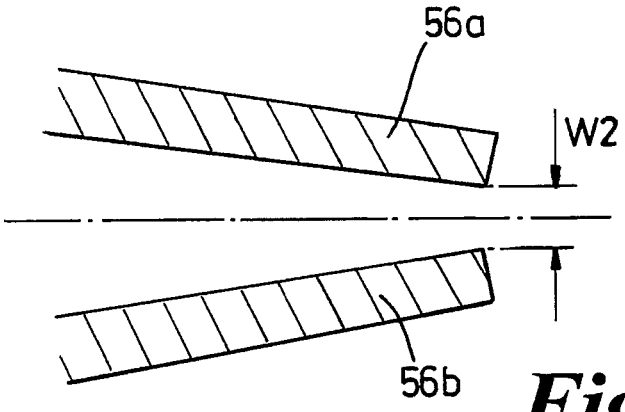
FIG. 6 is a schematic sectional side view, shown on the same further enlarged scale, of the slot-like opening located in the rear wall of the cavity of the hand dryer of FIG. 1.

FIG. 4 shows the upper ends of the air ducts 50, 52 and the slot-like openings 60, 62 in greater detail. As can be seen, the walls 54*a*, 54*b* of the air duct 50 converge to form the slot-like opening 60 and the walls 56*a*, 56*b* of the air duct 52 converge to form the slot-like opening 62. Even greater detail can be seen in FIGS. 5 and 6. FIG. 5 shows that the slot-like opening 60 has a width of W1 and FIG. 6 shows that the slot-like opening 62 has a width of W2. The width W1 of the slot-like opening 60 is smaller than the width W2 of the slot-like opening 62. The width W1 is 0.3 mm and the width W2 is 0.4 mm.

Sensors 64 are positioned in the front and rear walls 34, 36 of the cavity 30 immediately below the slot-like openings 60, 62. These sensors 64 detect the presence of a user's hands which are inserted into the cavity 30 via the cavity entrance 32 and are arranged to send a signal to the motor when a user's hands are introduced to the cavity 30. As can be seen from FIGS. 1 and 3, the walls 54*a*, 54*b*, 56*a*, 56*b* of the ducts 50, 52 project slightly beyond the surface of the front and rear walls 34, 36 of the cavity 30. The inward projection of the walls 54*a*, 54*b*, 56*a*, 56*b* of the ducts 50, 52 reduces the tendency of the user's hands to be sucked towards one or other of the walls 34, 36 of the cavity, which enhances the ease with which the hand dryer 10 can be used. The positioning of the sensors 64 immediately below the inwardly projecting walls 54*a*, 54*b*, 56*a*, 56*b* of the ducts 50, 52 also reduces the risk of the sensors 64 becoming dirty and inoperative.

As can be seen from FIG. 2, the shape of the cavity entrance 32 is such that the front edge 32*a* is generally straight and extends laterally across the width of the hand dryer 10. However, the rear edge 32*b* has a shape which consists of two curved portions 33 which generally follow the shape of the backs of a pair of human hands as they are inserted downwardly into the cavity 30 through the cavity entrance 32. The rear edge 32*b* of the cavity entrance 32 is substantially symmetrical about the centre line of the hand dryer 10. The intention of the shaping and dimensioning of the front and rear edges 32*a*, 32*b* of the cavity entrance 32 is that, when a user's hands are inserted into the cavity 30 through the cavity entrance 32, the distance from any point on the user's hands to the nearest slot-like opening is substantially uniform.

Figure 2A:
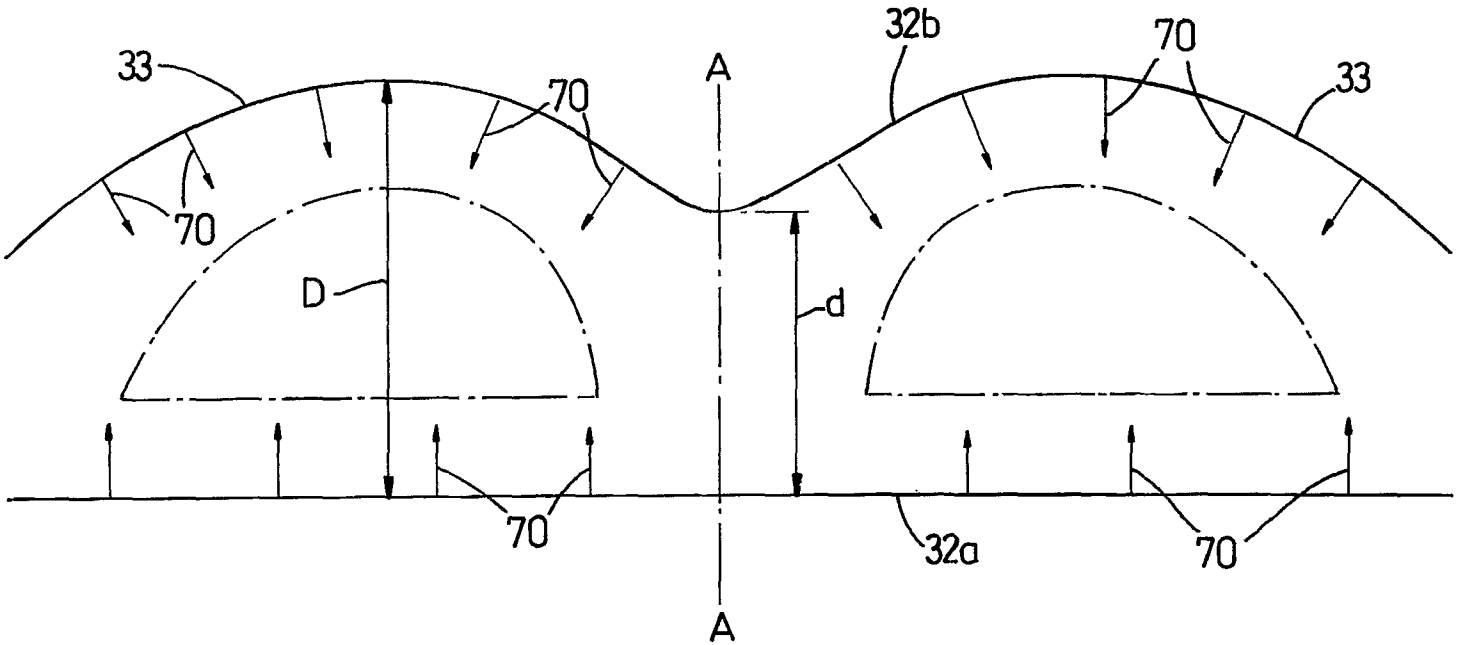
FIG. 2*a* is a plan view of the cavity entrance of the hand dryer of FIG. 1.

A plan view of the cavity entrance 32 is shown in FIG. 2*a*. The dotted lines indicate the position and shape of the user's hands as they are normally inserted into the cavity 30 between the front and rear edges 32*a*, 32*b*. As can be seen, the distance between the front and rear edges 32*a*, 32*b* varies along the length of the cavity entrance 32. Also, the distance between the user's hands and the nearest edge is substantially uniform. The curved portions 33 of the rear edge 32*b* are symmetrical about the centre line A-A of the cavity entrance 32 with the centre portion of the rear edge 32*b* being closer to the front edge 32*a* at the centre line than at a position spaced from the centre line. At the centre line, the distance d between the front and rear edges 32*a*, 32*b* is between 50 mm and 80 mm, in this embodiment 65 mm. The maximum distance D between the front edge and the rear edge is between 70 mm and 100 mm, in this embodiment 85 mm.

The arrows 70 shown in FIG. 2*a* indicate the direction of the airflow emitted from the slot-like openings 60, 62 located in the edges 32*a*, 32*b* of the cavity entrance 32. As can be seen, the airflow is emitted in a direction which is perpendicular to the respective edge 32*a*, 32*b*. In this way, the airflow has the maximum possible momentum when it hits the surface of the user's hands.

The hand dryer 10 described above operates in the following manner. When a user's hands are first inserted into the cavity 30 through the cavity entrance 32, the sensors 64 detect the presence of the user's hands and send a signal to the motor to drive the fan 40. The fan 40 is thus activated and air is drawn into the hand dryer 10 via the air inlet 44 at a rate of approximately 20 to 30 liters per second, preferably 25 to 27 liters per second. The air passes through the filter 46 and along the fan inlet 42 to the fan 40. The airflow leaving the fan 40 is divided into two separate airflows; one passing along the front air duct 50 to the slot-like opening 60 and the other passing along the rear air duct 52 to the slot-like opening 62.

The airflow is ejected from the slot-like openings 60, 62 in the form of very thin, stratified sheets of high velocity, high pressure air. As the airflows leave the slot-like openings 60, 62, the air pressure is at least 15 kPa and preferably approximately 20 to 23 kPa. Furthermore, the speed of the airflow leaving the slot-like openings 60, 62 is at least 80 m/s and preferably at least 100 or 150 m/s, more preferably approximately 180 m/s. Because the size of the slot-like opening 62 located at the end of the rear duct 52 is greater than the size of the slot-like opening 60 located at the end of the front duct 50, a larger volume of air is emitted from the duct 52 than from the duct 50. This provides a greater mass of air for drying the backs of the user's hands which is advantageous.

The two thin sheets of stratified, high velocity, high pressure air are directed towards the surfaces of the user's hands which, during use, are inserted fully into the cavity 30 and are subsequently withdrawn from the cavity 30 via the cavity entrance 32. As the user's hands pass into and out of the cavity 30, the sheets of air blow any existing water off the user's hands. This is achieved reliably and effectively because of the high momentum of the air leaving the slot-like openings 60, 62.

Each stratified sheet of air is directed towards the wall of the cavity 30 which is remote from the slot-like opening through which the respective sheet of air is emitted. Because the slot-like openings 60, 62 are also inclined towards the lowermost end of the cavity 30, the emitted airflows are directed into the cavity 30. This reduces the risk of turbulent air movement being felt by the user outside the casing, eg in the user's face.

It is envisaged that it will take only a small number of "passes" of the hand dryer described above to dry a user's hands to a satisfactory degree. (By "pass", we mean a single insertion of the hands into the cavity and subsequent removal therefrom at a speed which is not unacceptable to an average user. We envisage that a single pass will have a duration of no more than 3 seconds.) The momentum achieved by the airflows is sufficient to remove the majority of water found on the surface of the user's hands after washing during a single pass.

The water removed by the airflows is collected inside the cavity 30. Each airflow will rapidly lose its momentum once it has passed the user's hands and the water droplets will fall to the lower end of the cavity 30 under the forces of gravity whilst the air exits the cavity 30 either through the cavity entrance 32 or via the open sides of the cavity 30. The water, however, is collected by the drain 38 and passed to a reservoir (not shown) where it is collected for disposal. The reservoir can be emptied manually if desired. Alternatively, the hand dryer 10 can incorporate some form of water dispersal system including, for example, a heater for evaporating the collected water into the atmosphere. The means by which the collected water is dispersed does not form part of the present invention.

In an alternative embodiment, the slot-like openings 60*a*, 62*a* can be arranged so that the sheets of air which are emitted therefrom are directed generally along planes which are substantially parallel to one another. This minimises the amount of turbulent flow present inside the cavity 30 whilst the drying apparatus is in use.

The invention is not intended to be limited to the precise detail of the embodiment described above. Modifications and variations to the detail which do not alter the scope of the invention will be apparent to a skilled reader. For example, the slot-like openings described above can be replaced by lines of nozzles, each of which emits an individual jet of air towards the user's hands. Also, the means by which the water removed from the user's hands is disposed of may be altered without departing from the essence of the present invention.

The invention claimed is:

1. A hand drying apparatus, comprising a casing, a cavity formed in the casing for receiving a user's hands, a fan located in the casing and creating an airflow, and a plurality of openings communicating with the fan and arranged to direct an airflow transversely across the cavity, wherein the cavity has an entrance delimited by a front edge and a rear edge in which the openings are located, one of said edges being substantially straight and the other of said edges comprising two curved portions generally following the shape of the backs of a pair of human hands as they are inserted downwardly into the cavity through the cavity entrance.

2. The hand drying apparatus as claimed in claim 1, wherein the front edge of the cavity entrance is substantially straight and the rear edge comprises the two curved portions.

3. The hand drying apparatus as claimed in claim 2, wherein the shape of the rear edge is symmetrical about the centre of the cavity entrance.

4. The hand drying apparatus as claimed in claim 3, wherein the distance between the front edge and the rear edge decreases towards the centre of the cavity entrance.

5. The hand drying apparatus as claimed in claim 4, wherein the distance between the front edge and the rear edge at the centre of the cavity entrance is between 50 mm and 80 mm.

6. The hand drying apparatus as claimed in claim 5, wherein the distance between the front edge and the rear edge at the centre of the cavity entrance is about 65 mm.

7. The hand drying apparatus as claimed in claim 6, wherein the maximum distance between the front edge and the rear edge is between 70 mm and 100 mm.

8. The hand drying apparatus as claimed in claim 7, wherein the maximum distance between the front edge and the rear edge is about 85 mm.

9. The hand drying apparatus as claimed in any of claim 1, 2, or 3-8, wherein the openings are formed by continuous slots extending along the length of each of the front and rear edges.

10. The hand drying apparatus as claimed in claim 9, wherein the slots are arranged to emit air therefrom in a direction which is perpendicular to the extent of the slot.

11. The hand drying apparatus as claimed in any of claim 3, 4, or 5, wherein the maximum distance between the front edge and the rear edge is between 70 mm and 100 mm.

* * * * *